US007242380B2

(12) United States Patent
Hong

(10) Patent No.: US 7,242,380 B2
(45) Date of Patent: Jul. 10, 2007

(54) DISPLAY APPARATUS AND CONTROL METHOD THEREOF

(75) Inventor: Yun-ju Hong, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 627 days.

(21) Appl. No.: 10/802,733

(22) Filed: Mar. 18, 2004

(65) Prior Publication Data

US 2005/0035978 A1 Feb. 17, 2005

(30) Foreign Application Priority Data

Aug. 11, 2003 (KR) ..... 10-2003-0055450

(51) Int. Cl.
*G09G 3/36* (2006.01)
*G09G 5/02* (2006.01)
*G09G 3/34* (2006.01)

(52) U.S. Cl. ..... 345/88; 345/50; 345/51; 345/55; 345/87; 345/89; 345/104; 345/204; 345/214; 345/660; 345/698

(58) Field of Classification Search ..... 345/50, 345/51, 52, 55, 87, 88, 98, 104, 214, 660, 345/698, 699
See application file for complete search history.

(56) References Cited

U.S. PATENT DOCUMENTS 6,535,221 B1 * 3/2003 Allen et al. ..... 345/611
2002/0021273 A1 * 2/2002 Lee ..... 345/88
2003/0071769 A1 4/2003 Sullivan et al.

FOREIGN PATENT DOCUMENTS

| | | |
|---|---|---|
| CN | 1331443 | 1/2002 |
| JP | 64-63213 | 3/1989 |
| JP | 7-219470 | 8/1995 |
| JP | 10-161579 | 6/1998 |
| KR | 1997-57488 | 7/1997 |
| KR | 20-194414 | 6/2000 |
| KR | 2001-40306 | 5/2001 |
| KR | 2002-26112 | 4/2002 |

* cited by examiner

*Primary Examiner*—Richard Hjerpe
*Assistant Examiner*—My-Chau T. Tran
(74) *Attorney, Agent, or Firm*—Staas & Halsey LLP

(57) ABSTRACT

A display apparatus having: a panel displaying a picture; a panel driver enabling the panel to display the picture; a scaler transferring an input image signal to the panel driver; a key input part generating a color change execution signal for the input image signal by manipulation of a user; and a controller modifying a voltage level value of the input image signal and transferring a modified input image signal to the scaler, if the input image signal transferred to the scaler is identical over a predetermined period of time, after receiving the color change execution signal from the key input part. As described, an embodiment of the present invention provides the display apparatus and the control method thereof providing the user with the information displayed on the screen and preventing screen modulation when identical display data are displayed on the screen over the predetermined period of the time.

11 Claims, 4 Drawing Sheets

DISPLAY APPARATUS AND CONTROL METHOD THEREOF

CROSS-REFERENCE TO RELATED APPLICATIONS

This application claims the benefit of Korean Patent Application No. 2003-55450, filed Aug. 11, 2003, in the Korean Intellectual Property Office, the disclosure of which is incorporated herein by reference.

BACKGROUND OF THE INVENTION

1. Field of the Invention

The present invention relates to a display apparatus and a control method thereof, and more particularly, to a display apparatus and a control method thereof preventing a screen modulation when identical display data are displayed on a screen over a long period of time.

2. Description of the Related Art

A display apparatus, for example, a display apparatus used in an airport or a bank, often displays identical data carrying specific character messages over a long period of time at a stationary position on the display apparatus. In such case, a screen modulation occurs due to a physical variation of a displaying component of the display apparatus. For example, if an identical image is displayed on an LCD (liquid crystal display) over the long period of the time, an array of liquid crystals solidifies, making it difficult to display another image.

To solve such a problem, a method of adding dummy data at each specific frame using a pixel shift, a screen saver, or a scaler was adopted. But, the pixel shift and the screen saver cannot provide a user with information displayed on the screen. Particularly, the pixel shift cannot solve a screen modulation problem when an identical color is displayed within a fixed pixel shift range. Also, the screen may blink when the dummy data are added at each specific frame.

SUMMARY OF THE INVENTION

Accordingly, it is an aspect of the present invention to provide a display apparatus and a control method thereof providing a user with information displayed on a screen and preventing a screen modulation when identical display data are displayed on the screen.

Additional aspects and/or advantages of the invention will be set forth in part in the description which follows and, in part, will be obvious from the description, or may be learned by practice of the invention.

The foregoing and/or other aspects of the present invention are achieved by providing a display apparatus having: a panel displaying a picture; a panel driver enabling the panel to display the picture; a scaler transferring an input image signal to the panel driver; a key input part generating a color change execution signal for the input image signal by manipulation of a user; and a controller modifying a voltage level value of the input image signal and transferring a modified input image signal to the scaler, if the input image signal transferred to the scaler is identical over a predetermined period of time, after receiving the color change execution signal from the key input part.

According to an aspect of the invention, the display apparatus also has a storage storing a white voltage level value and a black voltage level value, wherein the controller determines a color reversion value of the input image signal on a basis of the white voltage level value and the black voltage level value stored in the storage to modify the voltage level value of the input image signal and transfer the modified input image signal to the scaler.

According to another aspect of the present invention, the above and/or other aspects are achieved by providing a control method of a display apparatus having a panel displaying a picture, a panel driver enabling the panel to display the picture, and a scaler transferring an input image signal to the panel driver, the method comprising: generating a color change execution signal from a key input part; checking if the input image signal transferred to the scaler over a predetermined period of time is identical; and modifying a voltage level for the input image signal if the input image signal is transferred to the scaler over the predetermined period of the time is identical.

According to an aspect of the invention, the control method of the display apparatus further comprises storing a white voltage level and a black voltage level, wherein modifying the voltage level for the input image signal is achieved by determining a color reversion value of the input image signal on a basis of the white voltage level value and the black voltage level value.

BRIEF DESCRIPTION OF THE DRAWINGS

The above and/or other aspects and advantages of the present invention will become apparent and more readily appreciated from the following description of the embodiments, taken in conjunction with the accompanying drawings, of which.

DETAILED DESCRIPTION OF THE PREFERRED EMBODIMENTS

Figure 1:
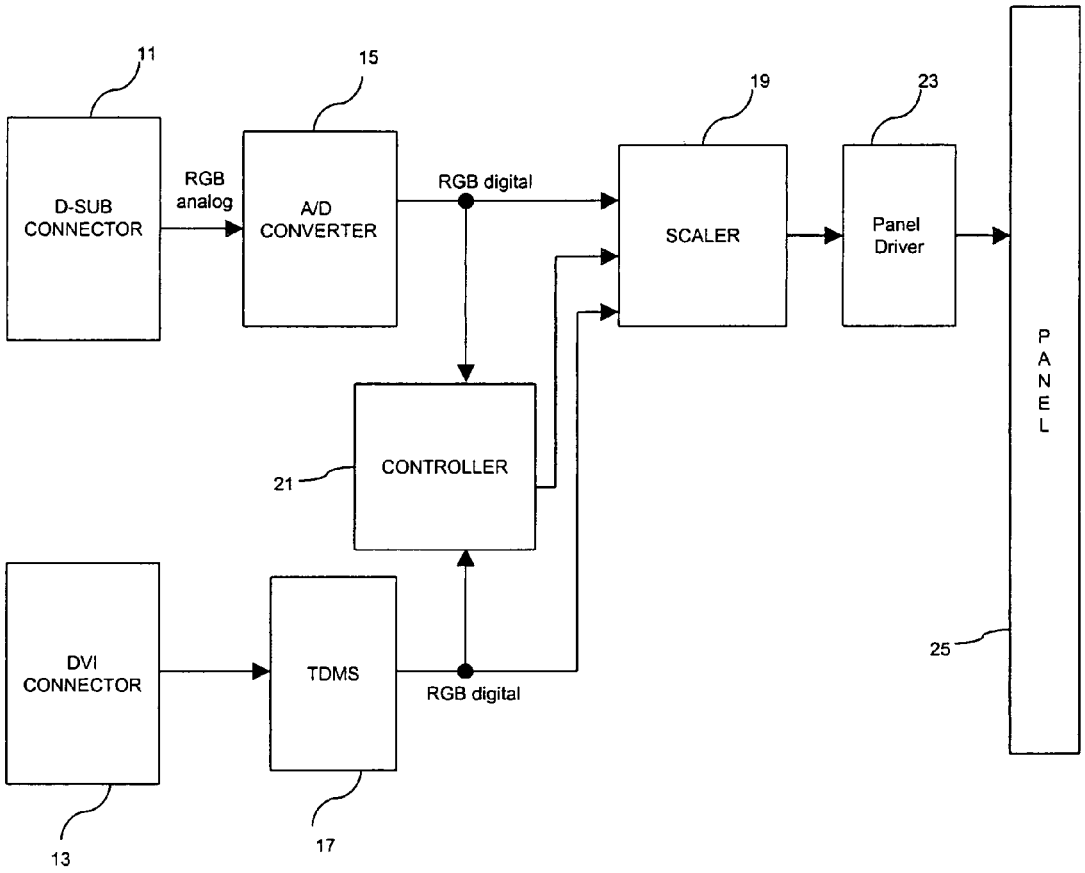
FIG. 1 is a block diagram of a display apparatus according to an embodiment of the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

Figure 2:
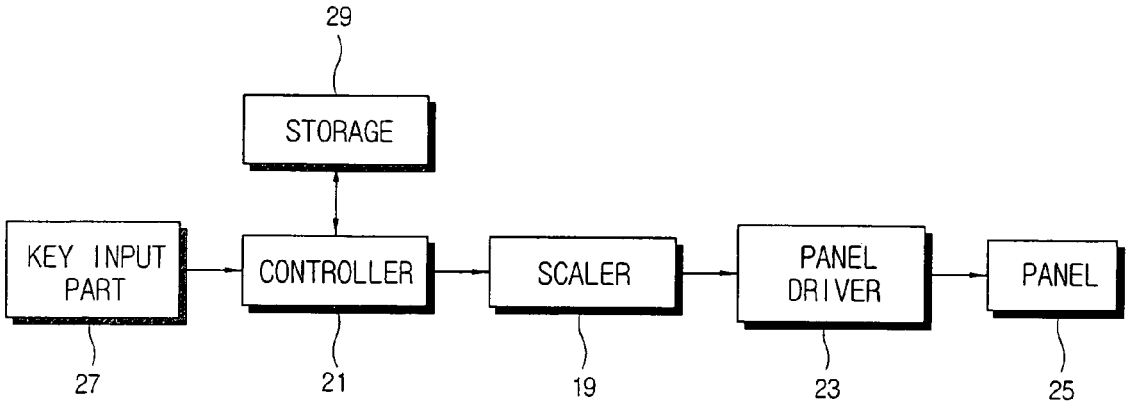
FIG. 2 is a control block diagram of the display apparatus of FIG. 1.

As illustrated in FIGS. 1 and 2, a display apparatus according to an embodiment of the present invention comprises a panel 25 displaying a picture, a panel driver 23 enabling the panel 25 to display the picture, a scaler 19 receiving a scaler image input signal, and transferring a panel driver input image signal to the panel driver 23, a controller 21, a key input part 27 generating a color change execution signal according to manipulation by a user, and a storage 29 storing a white voltage level value and a black voltage level value.

If an input image signal is an analog RGB-signal, the analog RGB-signal is transferred to an A/D converter 15 through a D-SUB connector 11. The A/D converter 15 converts the analog RGB-signal into a digital RGB-signal and transfers the digital RGB-signal to the scaler 19. In this case, the digital RGB-signal transferred by the A/D converter 15 is the scaler input image signal. If the input image signal is a digital signal, the digital signal is transferred to a TMDS part 17 through a DVI connector 13. The TMDS part 17 converts the digital signal into the digital RGB-signal and transfers the digital RGB-signal to the scaler 19. In this case, the digital RGB-signal transferred by the TDMS part 17 is the scaler input image signal.

A color of the picture displayed on the panel 25 is displayed by a voltage level adjustment of RGB-signals on a basis of the white voltage level value and the black voltage level value. Although the white voltage level value and the black voltage level value vary according to each kind of the display apparatus, the black voltage level value and the white voltage level value generally are configured to be about 0.1V and about 0.7V, respectively, for an LCD monitor. Accordingly, the color of the picture is displayed by each voltage level adjustment of the RGB-signals between about 0.1V and about 0.7V.

If the scaler input image signal transferred to the scaler 19 is identical over a predetermined period of time since the controller 21 received the color change execution signal from the key input part 27, the controller 21 modifies a voltage level value of the scaler input image signal and transfers the modified scaler input image signal to the scaler 19. In other words, if the scaler input image signal remains unchanged over a predetermined period of time, the controller modifies the voltage level value of the scaler input image signal. Accordingly, the color of the picture displayed on the panel 25 is changed.

Here, the controller 21 determines a color reversion value of the scaler input image signal on a basis of the white voltage level value and the black voltage level value stored in the storage 29, to modify the voltage level value of the scaler input image signal.

Determining the color reversion value refers to replacing the color of the picture displayed on the panel 25 with a corresponding complementary color. The idea of complementary colors refers to two colors becoming an achromatic color, such as the white or the black, when mixed in a proper ratio. For example, if a primary color and a secondary color become the white or the black when mixed properly, the complementary color of the primary color is the secondary color, and conversely, the complementary color of the secondary color s the primary color.

As an example, in the display apparatus having 0.1V and 0.7V as the black voltage level and the white voltage level, respectively, the sum of both voltage levels for the colors that are the complementary color to each other becomes 0.8V. Accordingly, if the present voltage level of an R-signal is 0.2V, the color reversion value becomes 0.6V, acquired by subtracting 0.2V from 0.8V. For a G-signal and a B-signal, respective color reversion values for the present voltage level can be decided in the same manner.

Accordingly, as illustrated in FIG. 2, if the color change execution signal for the input image signal is generated according to the manipulation by the user and transferred to the controller 21, the controller 21 checks if the scaler input image signal that has been transferred to the scaler 19 is identical (or unchanged) over the predetermined period of the time.

If so, the controller 21 modifies each voltage level value for the RGB-signals, and transfers the modified scaler input image signal to the scaler 19. Herein, the controller 21 determines the color reversion value of the input image signal on a basis of the black voltage level value and the white voltage level value stored in the storage 29, to modify the voltage level value for the scaler input image signal.

The scaler 19 transfers the scaler input image signal having the modified voltage level value to the panel driver 23 as the panel driver input image signal, and the panel driver 23 displays the picture on the panel 25 according to the panel driver input image signal.

Figure 3:
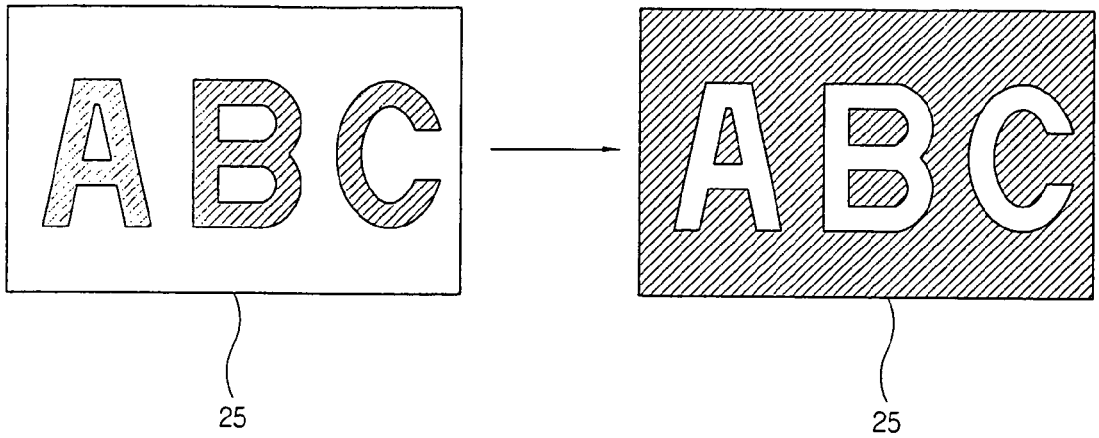
FIG. 3 is an exemplary color reversion of character data displayed on the display apparatus of FIG. 1.

Accordingly, as illustrated in FIG. 3, if the controller 21 receives the color change execution signal from the key input part 27, and if an identical black character image on a white background is displayed over the predetermined period of the time, the color reversion occurs, thereby converting the white into the black and the black into the white. As a result, the black character image on the white background turns into a white character image on a black background.

Figure 4:
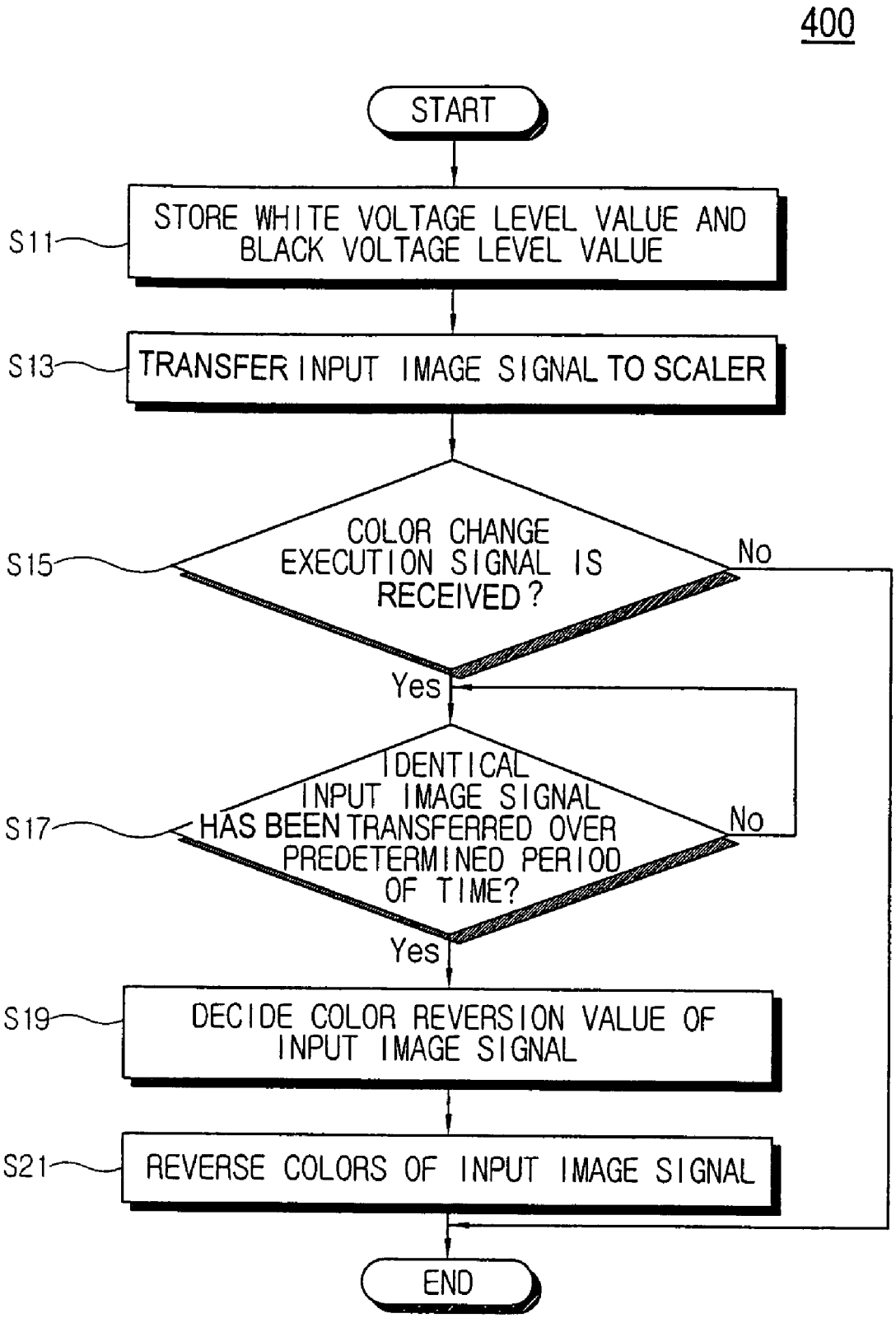
FIG. 4 is a control flow chart of the display apparatus of FIG. 1.

Hereinbelow, a control flow 400 of the display apparatus according to an embodiment of the present invention will be described with reference to FIG. 4.

In operation S11, the storage 29 stores the white voltage level value and the black voltage level value as a criterion of the voltage levels for the RGB-signals. Although the voltage levels vary according to the kinds of the display apparatus, the LCD monitor generally uses 0.1V and 0.7V as the black voltage level and the white voltage level, respectively. Also, the color of the picture is displayed by each voltage level adjustment of the RGB-signal between 0.1V and 0.7V.

In operation S13, the image signal inputted through the D-SUB connector 11 or the DIV connector 13 is transferred as the scaler input image signal to the scaler 19. In operation S15, if the color change execution signal for the input image signal is generated by the key input part 27 and transferred to the controller 21, then the controller 21 checks if the identical scaler input image signal has been transferred to the scaler 19 (in other words, if the scaler input image signal has remained the same) over the predetermined period of the time in operation S17.

In operation S15, if the controller 21 has not received the color change execution signal, then the control flow 400 ends. If, in operation S17, the identical scaler input image signal has not been transferred to the scaler 19 over the predetermined period, then the controller continues to check until the identical scaler input image has been transferred to the scaler 19 over the predetermined period of time.

In operation S19, if the identical scaler input image signal has been transferred to the scaler 19 over the predetermined period of the time, the controller 21 determines the color reversion value of the scaler input image signal on the basis of the black voltage level value and the white voltage level value stored in the storage 29, to modify the voltage level value for the scaler input image signal.

The scaler 19 transfers the scaler input image signal having the modified voltage level value to the panel driver 23 as the panel driver input image signal, and then the panel driver 23 displays the picture on the panel 25 according to the panel driver input image signal in operation S21.

As described, the embodiment of the present invention provides the display apparatus and the control method thereof, providing the user with the information displayed on the screen and preventing the screen modulation when the identical display data are displayed on the screen over the long period of the time.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A display apparatus having a panel displaying a picture, a panel driver enabling the panel to display the picture, and a scaler transferring an input image signal to the panel driver, the display apparatus comprising:

a key input part generating a color change execution signal for the input image signal by manipulation of a user; and a controller modifying a voltage level value of the input image signal and transferring a modified input image signal to the scaler, if the input image signal transferred to the scaler is identical over a predetermined period of time, after receiving the color change execution signal from the key input part.

2. The display apparatus according to claim 1, further comprising:

a storage storing a white voltage level value and a black voltage level value, wherein the controller determines a color reversion value of the input image signal on a basis of the white voltage level value and the black voltage level value stored in the storage, to modify the voltage level value of the input image signal and transfer the modified input image signal to the scaler.

3. A control method of a display apparatus having a panel displaying a picture, a panel driver enabling the panel to display the picture, and a scaler transferring an input image signal to the panel driver, the method comprising:

generating a color change execution signal from a key input part;

checking if the input image signal transferred to the scaler over a predetermined period of time is identical; and modifying a voltage level for the input image signal if the input image signal transferred to the scaler over the predetermined period of the time is identical.

4. The control method of the display apparatus according to claim 3, further comprising:

storing a white voltage level and a black voltage level, wherein modifying the voltage level for the input image signal is achieved by determining a color reversion value of the input image signal on a basis of the white voltage level value and the black voltage level value.

5. A display apparatus, comprising:

a panel displaying an image;

a panel driver receiving an image signal and enabling the panel to display the image;

a scaler receiving the image signal and transferring the image signal to the panel driver;

a key input part sending a color change execution signal according to manipulation by a user; and a controller, that upon receiving the color change execution signal and determining that the image signal received by the scaler is identical over a predetermined period of time, modifies a voltage level value of the image signal received by the scaler.

6. The display apparatus according to claim 5, further comprising:

a storage storing a first voltage level value and a second voltage level value, wherein the controller modifies the voltage level value of the image signal received by the scaler according to a determination of a color reversion value of the image signal received by the scaler prior to modification thereof, based on the first voltage level value and the second voltage level value.

7. The display apparatus according to claim 5, further comprising:

a storage storing a first voltage level value and a second voltage level value, wherein the controller determines a color reversion value of the image signal received by the scaler based on the first voltage level value and the second voltage level value, and based on the determined color reversion value, modifies the voltage level value of the image signal received by the scaler.

8. A display apparatus, comprising:

a scaler receiving an image signal;

a key input part sending a color change signal according to manipulation by a user; and a controller, selectively modifying a voltage level value of the image signal received by the scaler, according to receipt of the color change signal and a determination that the image signal received by the scaler is identical over a predetermined period of time.

9. The display apparatus according to claim 8, further comprising:

a storage storing a first voltage level value and a second voltage level value, wherein the controller determines a color reversion value of the image signal received by the scaler based on the first voltage level value and the second voltage level value, and based on the determined color reversion value, modifies the voltage level value of the image signal received by the scaler.

10. A method, comprising:

transferring an image signal to a scaler;

determining whether a key input part sent a color change signal according to manipulation by a user;

if determined that the key input part did not send the color change signal, ending the method;

if determined that the key input part did send the color change signal, determining whether the image signal transferred to the scaler is identical over a predetermined period of time; and if determined that the image signal transferred to the scaler is identical over the predetermined period of time, determining a color reversion value of the image signal transferred to the scaler, and based on the determined color reversion value, modifying a voltage level value of the image signal received by the scaler.

11. The method according to claim 10, further comprising:

storing first and second voltage level values, wherein the determining the color reversion value of the image signal transferred to the scaler is based on the first and second voltage level values.

* * * * *